United States Patent [19]

Tarasiuk

[11] 4,255,829

[45] Mar. 17, 1981

[54] INSTALLATION FOR REMOVAL OF SURPLUS MATERIAL FROM A BLOCK OF CELLULAR CONCRETE

[75] Inventor: Stefan Tarasiuk, Warsaw, Poland

[73] Assignee: Biuro Projektowo-Konstrukcyjne Mechanizacji Budownictwa Zremb, Warsaw, Poland

[21] Appl. No.: 50,943

[22] Filed: Jun. 21, 1979

[30] Foreign Application Priority Data

Jun. 26, 1978 [PL] Poland ..... 207930

[51] Int. Cl.[3] ..... A47L 5/38

[52] U.S. Cl. ..... 15/303; 294/64 R; 414/627

[58] Field of Search ..... 15/301, 303, 306 R, 15/306 A, 306 B, 339, 415, 422; 414/626, 627; 294/64 R, 65; 51/273

[56] References Cited

U.S. PATENT DOCUMENTS 3,571,839 3/1971 Hartmann et al. ..... 15/303

*Primary Examiner*—Christopher K. Moore

*Attorney, Agent, or Firm*—Edwin E. Greigg

[57] ABSTRACT

This invention relates to an installation for the removal of surplus material, especially from a block of cellular concrete utilizing suction means which includes a lever mechanism for lowering a suction nozzle controlled by means of a tension-member sensor consisting of a tension member stretched beneath a net of the suction nozzle, one end of said tension member being provided with a barrel cam co-operating with a limit switch designed for switching off the lever mechanism for lowering the suction nozzle, and simultaneously switching on fans.

Moreover, the lever mechanism for lowering the suction nozzle is equipped with an additional emergency switch controlled automatically by means of a shock absorber, switching off the lever mechanism for lowering the suction nozzle in the case of the tension-member sensor being inoperative.

6 Claims, 3 Drawing Figures

INSTALLATION FOR REMOVAL OF SURPLUS MATERIAL FROM A BLOCK OF CELLULAR CONCRETE

This invention relates to an installation for removal of surplus material, especially from a block of cellular concrete, utilizing auction.

BACKGROUND OF THE INVENTION

There are known installations for removal of surplus material using the suction method as, for instance, that according to the G.F.R. Patent Specification No. 1.683.837, wherein, the surplus material being cut off, is removed by means of a suction nozzle having the form of a dome co-operating with suitable fans, and being provided with a net stretched on a frame. When the suction nozzle is brought near the surplus material being cut off the vacuum produced by the fans causes this surplus material to stick to the net, enabling it to be removed from the block of concrete, being machined. Lowering of the suction nozzle and bringing it near to the surplus material is in known machines performed by means of lifting gears.

There are also known installations of a type wherein the lowering of the suction nozzle is performed by means of a lowering mechanism driven by four lead-screws or four hydraulic cylinders, controlled by means of vacuum relays, and wherein the fans are switched on simultaneously with the actuation of said lowering mechanism. As soon as the suction nozzle approaches the surface of the surplus material, the pressure in the suction nozzle drops resulting in disengaging of the lowering mechanism by the vacuum relay at the moment when the value of pressure has reached the pre-set value. In case of considerable irregularities in the surface of the surplus material to be removed the vacuum relay responds with a certain delay, and as a result the concrete block can be damaged in case the suction nozzle is lowered too deep. Moreover, the exhaust fans running during time the suction nozzle is lowered consume large amount of the electric energy.

OBJECT AND SUMMARY OF THE INVENTION

The object of the invention is to provide an installation for removal of surplus material using the suction method permitting smooth settling of the suction nozzle being lowered onto a block of cellular concrete, switching off the lowering mechanism and switching on the suction fans upon obtaining the required pressure, ensuring the required air-tightness between the suction nozzle and the surplus material to be removed, with no likelihood of damage to the concrete block.

The installation for removal of surplus material, especially from a block of cellular concrete, using the suction method includes a suction nozzle in the form of a dome co-operating with appropriate fans, and is provided with a net stretched on a frame. The installation according to the invention, is provided with a lever mechanism for lowering the suction nozzle which is controlled by means of a tension-member sensor consisting of a tension member disposed beneath the net, preferably in the plane of the transverse axis of the suction nozzle, one end of the tension member being provided with a cam cooperating with a limit switch for switching off the mechanism for lowering the suction nozzle, and switching on the fans.

The lever mechanism for lowering the suction nozzle is connected with the suction nozzle through an appropriate shock absorber, and is driven by a hydraulic cylinder having a piston rod, which is guided in a guide. The cam of the tension member has the form of a shaft guided in sleeves, and pretensioned by a spring. In the middle portion of the cam, co-operating with the limit switch, the cam is in the form of a cylinder terminating in conical surfaces. The tension member is stretched with rollers mounted on the suction nozzle in a way so as to render possible an adjustment of the distance between the tension member and the net. Moreover, the mechanism for lowering the suction nozzle is equipped with an additional emergency switch controlled by a shock absorber for stopping the motion of the suction nozzle lowering mechanism if the tention sensor is defective and does not operate properly.

As a result of the use of the lever mechanism for lowering the suction nozzle, the lever mechanism being connected with the suction nozzle through appropriate shock absorbers and driven by a hydraulic cylinder having a guided piston rod, a parallel guided flexible system is provided assuring a smooth settling of the suction nozzle on the surplus material to be removed, and jerkless lifting thereof. Thus, a close contact between the suction nozzle and the surplus material to be removed is ensured, a feature of substantial importance for the function of the installation. On the other hand, the tension-member sensor ensures the switching off of the lowering mechanism as soon as the pre-set value of pressure of the suction nozzle against the surplus material is reached, preventing damage to the concrete block, caused by crushing, and eliminating unnecessary nozzle is far from the surface of the surplus material. Moreover, the installation of the additional emergency switch controlled by a shock absorber for switching off the suction nozzle lowering mechanism in a case when the tension-member sensor does not operate properly, and has not disengaged the lowering mechanism, ensures perfect protection for the concrete block being cut against damage as well as protecting the entire installation against damage.

BRIEF DESCRIPTION OF THE DRAWING

The subject of the invention is described hereinbelow as directed more particularly to an exemplary embodiment with reference to the accompanying drawing, wherein.

DESCRIPTION OF THE PREFERRED EMBODIMENT

Figure 1:
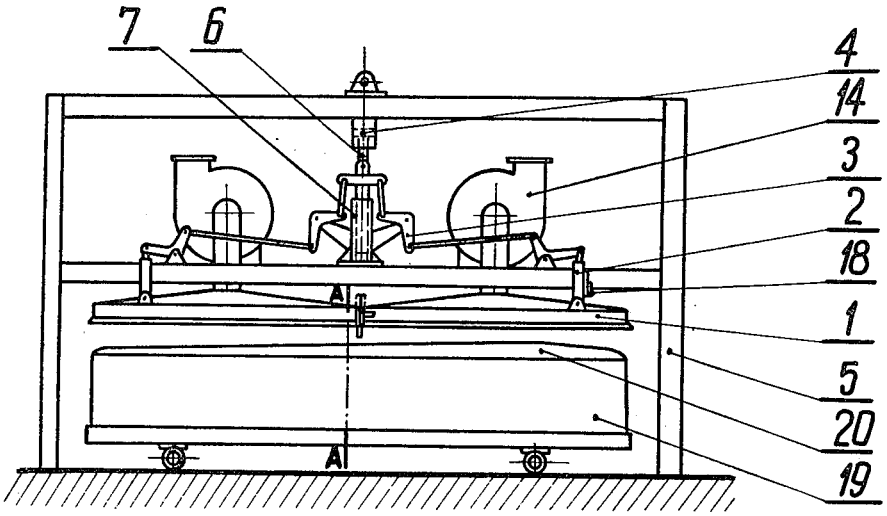
FIG. 1 is the front view of the installation according to the invention.
Figure 2:
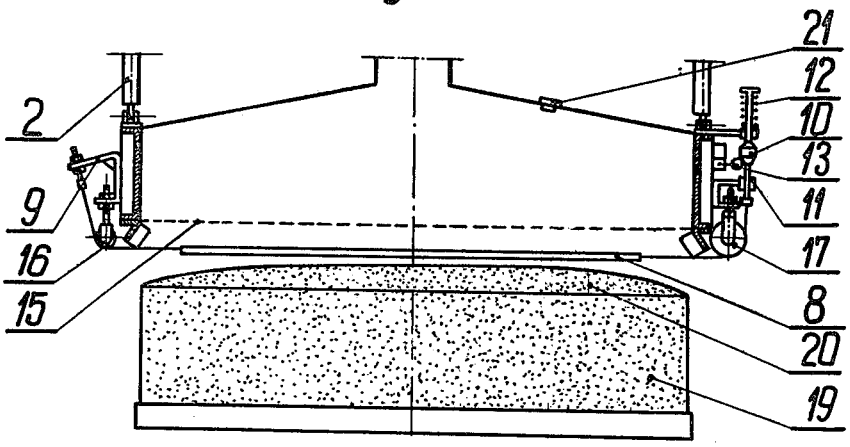
FIG. 2 is the enlarged sectional view taken along line A—A of FIG. 1 at the moment when the suction nozzle is brought close to the undercut surplus material.
Figure 3:
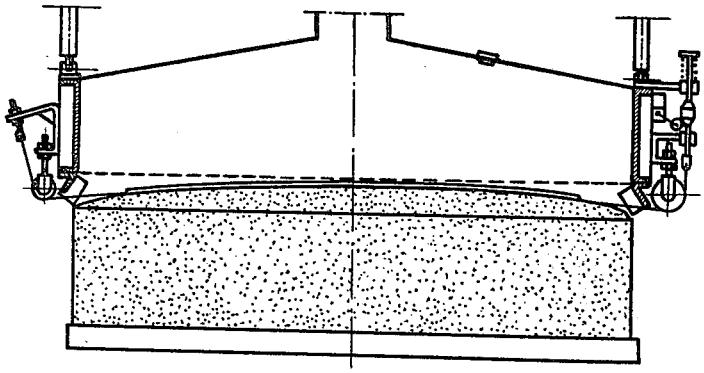
FIG. 3 is a view similar to FIG. 2 but at the moment of actuation of the tension-member sensor.

As shown in FIGS. 1–3 the suction nozzle 1 is suspended on four shock absorbers 2 from the lever mechanism 3 driven by a hydraulic cylinder 4 mounted on a supporting structure 5, the piston rod 6 of the hydraulic cylinder 4 being guided in a slidable way in the guide 7. The lever mechanism 3 is controlled by a tension-member sensor comprising a tension member 8 attaached at one end to a bracket 9 on the suction nozzle 1 at its other end to a barrel cam 10 arranged in sleeves 11 on the suction nozzle 1. The tension member sensor is stretched by means of a spring 12. The cam 10 co-operates with an electric limit switch 13 for stopping the lowering 4 the suction nozzle by the lever mechanism 3 and simultaneous switching on fans 14. For stretching the tension member 8 and adjusting the distance of the tension member from a net 15, a small roller 16 and the large roller 17 are provided. On one of the shock absorbers 2 there is installed an emergency electric switch 18 for switching off the mechanism which lowers the suction nozzle in case of a faulty operation of the tension-member sensor.

The installation according to the invention operates as follows: a block 19 of cellular concrete with surplus material 20 which has been cut off previously is introduced under the suction nozzle 1 being at this moment in its uppermost position. After stabilization of the block 19 the suction nozzle lowering mechanism 3 is set in motion and the suction nozzle 1 begins to move lower towards the concrete block 19. After coming into contact with the surplus material 20, the tension member 8 of the sensor becomes tensioned and actuates the barrel cam 10. The cam 10 cooperates with the limit switch 13, stopping the suction nozzle from further movement and switching on the fans 14. After starting, the fans 14 produce the required vacuum in the suction nozzle 1 and thus suck us the surplus material 20 causing it to adhere to the net 15 of the suction nozzle 1. The sucking up of the surplus material 20 is followed by a further pressure drop in the suction nozzle 1, and as soon as the required vacuum is obtained, the vacuum gauge 21 produces an electric signal for starting the lifting motion of the suction nozzle 1 together with the surplus material 20 sticking to it. The surplus material 20 being handled is dropped simply by switching off the fans 14. If the tension member 8 does not operate properly, and has not stopped the movement of the mechanism 3, then the additional emergency switch 18 stops the lever mechanism 3 from lowering the suction nozzle 1 as soon as the pre-set safe deflections of the shock absorbers 2 have been exceeded.

References used in the Drawing

1—Suction nozzle
2—Shock absorber
3—Lever mechanism
4—Hydraulic cylinder
5—Supporting structure
6—Piston rod
7—Piston rod guide
8—Tension member
9—Bracket
10—Barrel can
11—Sleeve
12—Spring
13—Limit switch
14—Fan
15—Net
16—Roller (small)
17—Roller (large)
18—Emergency switch
19—Concrete block
20—Surplus material (top layer of concrete to be removed as oversize material)
21—Vacuum gauge

What is claimed is:

1. An installation for the removal of surplus material, from a block of cellular concrete or the like with the use of suction comprising, in combination, a suction nozzle, a lever mechanism for lowering said suction nozzle, means for driving said lever mechanism, said suction nozzle having a bowl-shaped configuration, at least one fan arranged to cooperate with said suction nozzle, said suction nozzle including a frame having a net stretched thereon, a tension-member sensor comprising a tension member arranged on said suction nozzle under said net in the plane of the transverse axis of said suction nozzle, a limit switch on said suction nozzle, a cam arranged to cooperate with said limit switch connected to one of the ends of said tension member, said limit switch being arranged to switch off said suction nozzle lowering mechanism, and to simultaneous switch on said fans.

2. An installation as defined in claim 1, including a plurality of shock absorbers for connecting said lever mechanism for lowering the suction nozzle to said suction nozzle.

3. An installation as defined in claim 2, including an emergency switch operatively associated with said lever mechanism for lowering said suction nozzle and wherein said emergency switch is controlled by at least one of said plurality of shock absorbers.

4. An installation as defined in claim 1, wherein said means for actuating said lever mechanism for lowering said suction nozzle comprises a hydraulic cylinder having a piston rod, a guide, one end of said piston rod being guided in said guide.

5. An installation as defined in claim 1, wherein said cam includes a shaft, a sleeve for guiding said shaft and wherein said cam incudes a middle portion in the form of a cylinder terminating in a cone arranged to engage said limit switch.

6. An installation as defined in claim 1, wherein said tension member includes a pair of stretching rollers mounted on said suction nozzle in an adjustable manner for adjusting the distance between said tension member and said net.

* * * * *